US009155371B2

(12) United States Patent
Wagner et al.

(10) Patent No.: US 9,155,371 B2
(45) Date of Patent: Oct. 13, 2015

(54) DEVICE, SYSTEM AND METHOD FOR APPLYING AT LEAST ONE APPLICATION AGENT TO HAIR

(76) Inventors: Anke Wagner, Salem (DE); Daniel Eiche, Gailingen (DE); Peter Roth, Horgenzell (DE); Andreas Muehlberger, Muenchen-Grasbrunn (DE); Michael Muehlberger, Zell am Harmersbach (DE)

( * ) Notice: Subject to any disclaimer, the term of this patent is extended or adjusted under 35 U.S.C. 154(b) by 0 days.

(21) Appl. No.: 13/701,385

(22) PCT Filed: Jun. 1, 2011

(86) PCT No.: PCT/EP2011/002713

§ 371 (c)(1),
(2), (4) Date: May 31, 2013

(87) PCT Pub. No.: WO2011/151067

PCT Pub. Date: Dec. 8, 2011

(65) Prior Publication Data

US 2013/0255708 A1 Oct. 3, 2013

(30) Foreign Application Priority Data

| | | |
|---|---|---|
| Jun. 2, 2010 | (DE) | 10 2010 022 471 |
| Jun. 30, 2010 | (DE) | 10 2010 025 655 |
| Jul. 28, 2010 | (DE) | 10 2010 032 593 |
| Jul. 28, 2010 | (DE) | 10 2010 032 594 |
| Jul. 28, 2010 | (DE) | 10 2010 032 595 |
| Jul. 28, 2010 | (DE) | 10 2010 032 596 |
| Jul. 28, 2010 | (DE) | 10 2010 032 608 |
| Jul. 28, 2010 | (DE) | 10 2010 032 609 |
| Oct. 15, 2010 | (DE) | 10 2010 048 445 |

(51) Int. Cl.
*A45D 24/22* (2006.01)
*A45D 7/04* (2006.01)
(Continued)

(52) U.S. Cl.
CPC *A45D 19/00* (2013.01); *A45D 7/04* (2013.01); *A45D 19/0008* (2013.01); *A45D 19/02* (2013.01); *A45D 24/28* (2013.01); *A45D 2019/0091* (2013.01)

(58) Field of Classification Search
CPC ... A45D 19/00; A45D 19/02; A45D 19/0008; A45D 7/04; A45D 24/28; A45D 24/22; A45D 24/24; A45D 24/26; A45D 2019/0091; A45D 2019/0041; A45D 2019/0066; A45D 2019/0083
USPC ..... 132/116, 207, 208, 212, 108–115, 317, 132/320, 221, 270, 200; 401/16, 17, 26, 27, 401/66, 126, 132–135, 138, 145, 156, 185; 222/92, 95, 96, 142.5, 145.4, 325, 328, 222/541.1, 541.2, 541.3, 541.4, 541.9, 543; 53/133.5, 133.6, 133.7, 133.8, 134.1; 206/581, 823
See application file for complete search history.

(56) References Cited

U.S. PATENT DOCUMENTS

| | | | | |
|---|---|---|---|---|
| 859,711 | A * | 7/1907 | Winsor | 132/114 |
| 1,058,560 | A | 4/1913 | Dancy | |

(Continued)

FOREIGN PATENT DOCUMENTS

| | | | |
|---|---|---|---|
| EP | 1512341 | A1 | 3/2005 |
| JP | 2004154173 | A | 6/2004 |

(Continued)

OTHER PUBLICATIONS

International Search Report for PCT/EP2011/002713, mailed Nov. 16, 2011.

(Continued)

*Primary Examiner* — Vanitha Elgart

(57) ABSTRACT

The invention relates to a device for applying at least one application agent to hair, comprising a housing unit (11*a;* 11*b;* 11*c*) which at least partially encloses at least one depot volume (12*a;* 12*b;* 12*c*) for accommodating at least one component of the at least one application agent (10*a;* 10*b;* 10*c*). According to the invention, the device comprises a dispenser unit (13*a;* 13*b;* 13*c*) which is designed to discharge the at least one component of the application agent (10*a;* 10*b;* 10*c*) from an application agent container (14*a;* 14*b;* 14*c*) that is at least partially inserted into the depot volume (12*a;* 12*b;* 12*c*).

15 Claims, 5 Drawing Sheets

Figure 1:
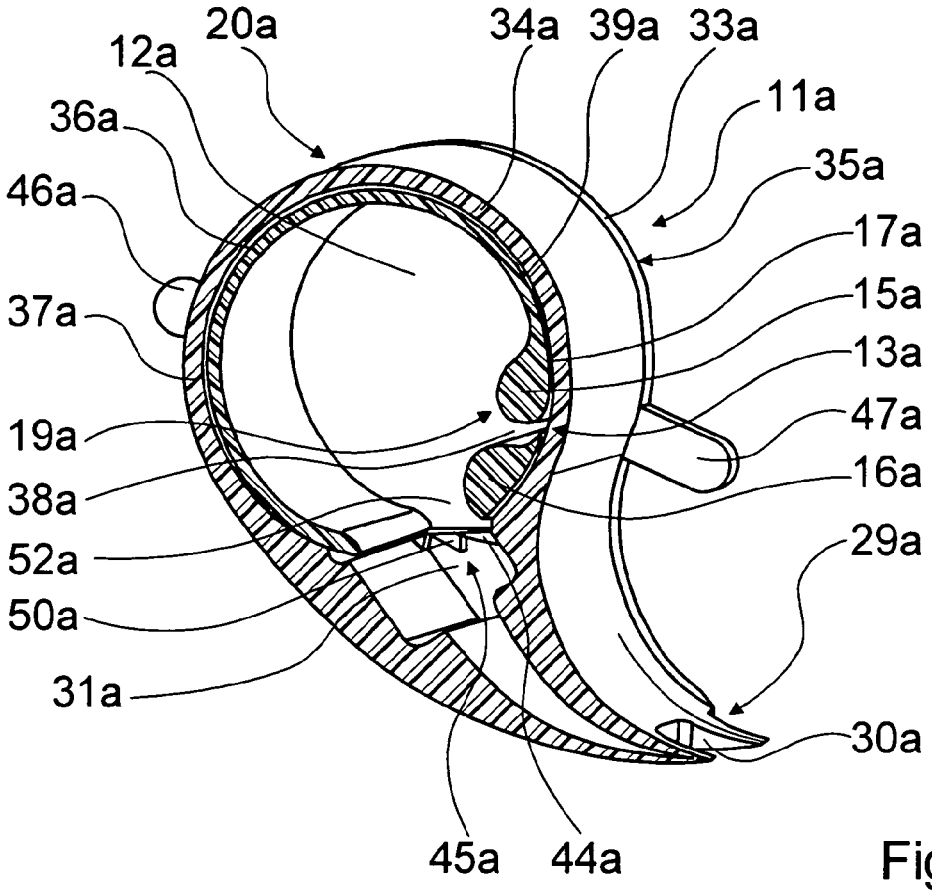

(51) Int. Cl.

| | |
|---|---|
| ***A61Q 5/08*** | (2006.01) |
| ***A61Q 5/10*** | (2006.01) |
| ***A61K 8/18*** | (2006.01) |
| ***A45D 19/00*** | (2006.01) |
| ***A45D 19/02*** | (2006.01) |
| ***A45D 24/28*** | (2006.01) |

(56) References Cited

U.S. PATENT DOCUMENTS

| | | | | |
|---|---|---|---|---|
| 1,232,005 | A | 7/1917 | Cottle | |
| 1,525,955 | A | 2/1925 | Sanders | |
| 2,031,774 | A | 2/1936 | Helfrich et al. | |
| 2,209,914 | A * | 7/1940 | Wiesendanger, Jr. et al. | 604/306 |
| 2,276,886 | A | 3/1942 | Smith | |
| 2,278,811 | A * | 4/1942 | Wallenius | 132/116 |
| 2,381,048 | A | 8/1945 | Habostad | |
| 2,446,398 | A | 8/1948 | Wilson | |
| 2,517,152 | A | 8/1950 | Wilson | |
| 2,895,486 | A | 7/1959 | Sayer | |
| 2,897,826 | A | 8/1959 | Di Vito | |
| 2,922,425 | A | 1/1960 | Lerner et al. | |
| 3,353,721 | A | 11/1967 | Love | |
| 3,463,170 | A * | 8/1969 | McCullough | 132/113 |
| 3,786,820 | A * | 1/1974 | Kopfer | 132/74.5 |
| 3,998,559 | A * | 12/1976 | Hoyt | 401/132 |
| 4,013,086 | A | 3/1977 | Chmela | |
| 4,090,522 | A | 5/1978 | Donley | |
| 4,147,278 | A * | 4/1979 | Uhlig | 222/94 |
| 4,209,027 | A | 6/1980 | Morganroth | |
| 4,310,009 | A | 1/1982 | Shipp | |
| 4,902,154 | A * | 2/1990 | Valenza | 401/132 |
| 5,005,733 | A * | 4/1991 | Stoody | 222/105 |
| 5,024,243 | A | 6/1991 | Snyder | |
| 5,054,504 | A | 10/1991 | Winrow | |
| 5,060,679 | A | 10/1991 | Christopher et al. | |
| 5,076,298 | A | 12/1991 | Busch et al. | |
| 5,152,305 | A | 10/1992 | Niv | |
| 5,215,106 | A | 6/1993 | Choi | |
| 5,289,833 | A | 3/1994 | McDonald | |
| 5,311,887 | A | 5/1994 | Ramsey | |
| 5,325,878 | A | 7/1994 | McKay | |
| 5,332,121 | A * | 7/1994 | Schmidt et al. | 222/95 |
| 5,333,627 | A | 8/1994 | Mehringer et al. | |
| 5,339,839 | A | 8/1994 | Forcelledo et al. | |
| 5,909,737 | A | 6/1999 | Ricco | |
| 5,927,290 | A * | 7/1999 | Thiruppathi | 132/116 |
| 5,947,130 | A | 9/1999 | Musum | |
| 6,047,703 | A | 4/2000 | Paglericcio et al. | |
| 6,112,751 | A | 9/2000 | Bennett | |
| 6,260,557 | B1 | 7/2001 | Yarbrough | |
| 6,334,449 | B1 * | 1/2002 | Burrowes et al. | 132/114 |
| 6,357,449 | B1 * | 3/2002 | Chu et al. | 132/112 |
| 6,378,529 | B1 | 4/2002 | Clemente Marco | |
| 6,488,428 | B1 * | 12/2002 | Fischer | 401/133 |
| 6,508,602 | B1 * | 1/2003 | Gruenbacher et al. | 401/7 |
| 6,539,949 | B2 | 4/2003 | Christensen | |
| 6,752,157 | B2 * | 6/2004 | Lu Shao Hua | 132/109 |
| 6,766,806 | B2 | 7/2004 | Thiebaut | |
| 6,811,338 | B1 * | 11/2004 | Manske et al. | 401/7 |
| 7,044,137 | B2 * | 5/2006 | Glucksman et al. | 132/114 |
| 7,059,333 | B2 | 6/2006 | Duqueroie | |
| 7,114,636 | B2 * | 10/2006 | Yoshimoto et al. | 222/105 |
| 7,243,660 | B2 | 7/2007 | Capristo | |
| 7,322,364 | B2 * | 1/2008 | Hurwitz | 132/116 |
| 7,334,583 | B2 | 2/2008 | Niv | |
| 7,419,321 | B2 * | 9/2008 | Tereschouk | 401/133 |
| 7,565,987 | B2 * | 7/2009 | Bauer | 222/107 |
| 7,575,384 | B2 * | 8/2009 | Bauer et al. | 401/7 |
| 7,658,542 | B2 * | 2/2010 | Risgalla | 383/44 |
| 7,934,512 | B2 | 5/2011 | Spagnuolo | |
| 7,950,864 | B2 * | 5/2011 | Bauer et al. | 401/132 |
| 8,118,036 | B2 | 2/2012 | Wang et al. | |
| 8,220,469 | B1 | 7/2012 | Spagnuolo | |
| 8,402,979 | B2 | 3/2013 | McHugh | |
| 8,534,947 | B2 * | 9/2013 | Prax | 401/133 |
| 2002/0153020 | A1 | 10/2002 | Fiore | |
| 2003/0029468 | A1 | 2/2003 | Choi | |
| 2004/0016440 | A1 | 1/2004 | De Laforcade et al. | |
| 2004/0118423 | A1 | 6/2004 | Stankovic et al. | |
| 2005/0028833 | A1 | 2/2005 | Christine Vena et al. | |
| 2005/0072442 | A1 * | 4/2005 | Licari et al. | 132/112 |
| 2005/0092340 | A1 | 5/2005 | Rijskamp | |
| 2005/0183736 | A1 | 8/2005 | Wang et al. | |
| 2005/0211261 | A1 | 9/2005 | Capristo | |
| 2006/0283471 | A1 * | 12/2006 | Kimura et al. | 132/112 |
| 2007/0068545 | A1 | 3/2007 | Dallianis et al. | |
| 2007/0079843 | A1 | 4/2007 | Niv | |
| 2008/0142030 | A1 * | 6/2008 | Venere et al. | 132/116 |
| 2009/0114237 | A1 * | 5/2009 | Massoni et al. | 132/208 |
| 2009/0152267 | A1 * | 6/2009 | May et al. | 220/23.83 |
| 2010/0288297 | A1 * | 11/2010 | Stern et al. | 132/221 |
| 2013/0174860 | A1 * | 7/2013 | Takagi | 132/200 |

FOREIGN PATENT DOCUMENTS

| | | | |
|---|---|---|---|
| WO | 9820771 | A1 | 5/1998 |
| WO | 2007019644 | A1 | 2/2007 |
| WO | 2007044538 | A2 | 4/2007 |

OTHER PUBLICATIONS

International Search Report and Written Opinion; PCT/EP2011/002711; Nov. 16, 2011.

International Search Report and Written Opinion; PCT/EP2011/002714: Nov. 16, 2011.

Non-Final Office Action for Related U.S. Appl. No. 13/701,412—Nov. 15, 2013.

International Preliminary Report on Patentability for International Application No. PCT/EP2011/002714, mailed Dec. 13, 2012, 16 pages.

International Preliminary Report on Patentability for International Application No. PCT/EP2011/002711, mailed Dec. 13, 2012, 13 pages.

Written Opinion of the International Searching Authority (EP) dated Nov. 16, 2011 for International Application No. PCT/EP2011/002713, 13 pages.

International Preliminary Report on Patentability for International Application No. PCT/EP2011/002713, mailed Dec. 13, 2012, 15 pages.

Non-Final Office Action; U.S. Appl. No. 13/701,412; Sep. 9, 2014, 35 pgs.

* cited by examiner

DEVICE, SYSTEM AND METHOD FOR APPLYING AT LEAST ONE APPLICATION AGENT TO HAIR

CROSS REFERENCES TO RELATED APPLICATIONS

This application claims the benefit of German Patent Application No. DE 10 2010 022 471.5, filed on Jun. 2, 2010, hereby incorporated by reference in its entirety; German Patent Application No. DE 10 2010 025 655.2, filed on Jun. 30, 2010, hereby incorporated by reference in its entirety; German Patent Application No. DE 10 2010 032 609.7, filed on Jul. 28, 2010, hereby incorporated by reference in its entirety; German Patent Application No. DE 10 2010 032 596.1, filed on Jul. 28, 2010, hereby incorporated by reference in its entirety; German Patent Application No. DE 10 2010 032 595.3, filed on Jul. 28, 2010, hereby incorporated by reference in its entirety; German Patent Application No. DE 10 2010 032 593.7, filed on Jul. 28, 2010, hereby incorporated by reference in its entirety; German Patent Application No. DE 10 2010 032 594.5, filed on Jul. 28, 2010, hereby incorporated by reference in its entirety; German Patent Application No. DE 10 2010 032 608.9, filed on Jul. 28, 2010, hereby incorporated by reference in its entirety; German Patent Application No. DE 10 2010 048 445.8, filed on Oct. 15, 2010, hereby incorporated by reference in its entirety.

PRIOR ART

The invention relates to a device for applying at least one application agent to hair, according to the preamble of claim 1.

The problem addressed by the invention is particularly that of providing a device in which an application agent can be easily dispensed from an application agent container, wherein the probability that the application agent will be discharged unintentionally and a user will unintentionally come into contact with the application agent can be decreased. This problem is solved according to the invention by the features of claim 1 and of the independent claims. Additional embodiments are specified in the dependent claims.

ADVANTAGES OF THE INVENTION

The invention relates to a device for applying at least one application agent to hair, comprising a housing unit which at least partially encloses at least one depot volume for accommodating at least one component of the at least one application agent.

It is proposed that the device comprises a dispenser unit which is provided for discharging the at least one component of the application agent from an application agent container that is at least partially inserted into the depot volume. A device that is easy to operate can thereby be provided, by means of which an application agent for hair, particularly a hair dye or hair coloring agent, for example, can be easily applied to hair. With an embodiment according to the invention, it can particularly be achieved that the application agent can be easily dispensed from the application agent container, wherein the probability that the application agent will be dispensed unintentionally can be decreased. "At least partially encloses" in this context is understood to mean that the housing unit at least largely encloses the depot volume, thereby preventing a discharge of application agent from the depot volume. An "application agent container inserted into the depot volume" is understood to mean a container embodied separately from the housing unit of the device, which is arranged at least partially within the depot volume that is spanned by the housing unit and which contains at least one component of the application agent. Moreover, the size of the depot volume is preferably designed to accommodate the entire amount of application agent contained in the application agent container. The depot volume is preferably large enough that the application agent container can be positioned entirely or nearly entirely, i.e., at least 90 percent, within the depot volume. "Discharging" is understood particularly to mean that the application agent is actively discharged from the application agent container. "Provided" is particularly understood to mean specially equipped and/or designed.

An application agent is understood to be a liquid, paste-like or powdered medium which is provided for application to hair, particularly a hair dye, hair treatment agent, hair gloss, dispersion, body modifying agent, and/or pharmaceutical hair treatment agent. In principle, the application agent can be embodied as a single-component agent or as a multicomponent agent. A "single-component agent" is understood as an agent that is stored ready for use in the application agent container. A "multicomponent agent" is understood particularly as an agent that comprises two separately stored components, which are designed to be mixed together for application. In this case, it is conceivable for one of the components to be stored in the depot volume and one of the components to be stored in the application agent container.

It is further proposed that the dispenser unit comprises at least one squeezing element. With it, the application agent can be discharged particularly easily. A "squeezing element" is understood particularly as an element of the dispenser unit which is provided for generating a partial vacuum in the application agent container in at least one operating state. The application agent container and the squeezing element can preferably be moved relative to one another, wherein the dispenser unit particularly preferably has two squeezing elements securely connected to the housing unit, and the application agent container is embodied for being moved relative to the squeezing elements.

The dispenser unit is preferably provided for manual operation. A costly control system can thereby be dispensed with, allowing a simple and cost-effective device to be produced. "Manual dispensing" in this context is particularly to be understood as dispensing to be actuated by the operator, independently of an external energy source, especially an electrical power supply. The device preferably comprises an actuator mechanism, which is provided for influencing a force applied by a user. An "actuator mechanism" is particularly understood in this context as a unit having at least two components that are movable relative to one another, the kinematics or kinetics of which are mechanically defined, for example, a linear guide, a rotary guide or a force reversal unit.

It is further proposed that the device comprises a pull-on element, which is provided for pulling at least one part of the application agent container through at least one part of the dispenser unit. In this manner, a structurally particularly simple dispenser unit can be implemented. The pull-on element is designed to be securely fastened to the application agent container. If the pull-on element is further designed to guide the at least one part of the application agent container past the at least one squeezing element, the application agent can be dispensed easily and in an uncomplicated fashion from the application agent container.

In a further embodiment it is proposed that the device has a pressing element, which is provided for compressing the application agent container. A further advantageous embodiment can thereby be achieved. The pressing element is preferably provided for decreasing the volume that is enclosed by a wall of the application agent container, thereby discharging the application agent from the application agent container.

It is further advantageous for the device to have an opening unit, which is provided for opening the application agent container inside the depot volume. In this manner, the application agent container can be easily opened, thereby substantially decreasing the risk of the user inadvertently coming into contact with the application agent. An "opening inside the depot volume" is particularly understood within this context to mean that the opening unit is provided for opening the application agent container, wherein at least the part of the application agent container that encompasses the application agent is arranged entirely within the depot volume.

With particular preference, the dispenser unit and the opening unit are embodied as at least partially integral. In this manner, a combined actuation of the dispenser unit and the opening unit can particularly be implemented, thereby resulting in particularly easy handling. Structural cost can also be reduced. "Integral" is particularly understood as meaning at least non-positively connected, for example, by a welding process, an adhesive process, a spraying process and/or some other process deemed expedient by a person skilled in the art, and/or advantageously, as formed as a single piece, for example, through production in a casting process and/or production in a single- or multicomponent injection molding process, and advantageously from a single blank.

The device preferably comprises at least two housing parts, which are rotatable relative to one another. In this manner, the dispenser unit can be particularly simple in embodiment. It is further advantageous for the two housing parts to be arranged spaced from one another in at least one area, and to enclose an open space, which is provided for accommodating the application agent container once the application agent has been dispensed. An embodiment of this type can be provided, in principle, for any application agent, for example, food, adhesive substances, or other products. As a further aspect of the invention, as an independent inventive concept, a device having a housing unit is therefore proposed, which at least partially encloses at least one depot volume for accommodating at least one component of an application agent, and which comprises at least two housing parts that form a dispenser unit, which is provided for discharging the at least one component of the application agent from an application agent container that is inserted at least partially into the depot volume. A device of this type can have an applicator, which can in principle have any design, for example, as a brush or a needle. However, it is also conceivable for the device to comprise merely an attachment for an applicator, or for an applicator to be dispensed with entirely.

Further proposed is an application agent container for a device for applying at least one application agent to hair, particularly an application agent container for at least partial insertion into a device according to the invention, which encloses at least one volume in which at least one component of an application agent for application to hair is placed, wherein the wall is dimensionally unstable in at least one partial region. In this manner, a particularly advantageous application agent container for a device according to the invention can be implemented. In particular, an application agent container can thereby be provided, from which the application agent can be easily discharged. "Dimensionally unstable" in this context is particularly understood to mean that the volume enclosed by the wall can be decreased by deforming the wall to less than 50 percent of an initial volume, preferably to less than 10 percent of an initial volume, and particularly advantageously to nearly zero. The force that is necessary for deformation is preferably low enough that it can be applied effortlessly by an operator.

The wall is preferably film-like in at least the one partial area. In this manner, the dimensionally unstable embodiment can be particularly easily implemented. "Film-like" in this context is understood particularly to mean that the wall in at least one partial region is less than 1 millimeter thick, preferably less than 0.5 millimeter thick. The wall is preferably made of a plastic.

It is further proposed that the application agent container has a tubular basic shape, which is provided for squeezing. In this manner, an application agent container can be achieved which can advantageously be easily squeezed. A "basic shape" is understood in this context particularly as a shape of the application agent container in the filled state. A "tubular" basic shape is particularly understood as a basic shape having a main direction of extension which extends from a first end in the direction of a second end and along which the dimension of the application agent container is greater than dimensions that extend along transverse directions of extension perpendicular to the main direction of extension. The application agent container is preferably designed for squeezing along a main direction of extension. "Squeezing along the main direction of extension" is particularly understood in this context to mean that the application agent container is squeezed by partial compression starting at the one end and moving successively in the direction of the other end. The basic shape can particularly also be trapezoidal, i.e., having a cross-section that tapers along the main direction of extension. In principle, however, it is also conceivable for the application agent container to be provided for squeezing along a transverse direction of extension.

In an alternative embodiment, it is proposed that the application agent container has a pad-shaped basic shape, which is designed for squeezing via compression. A further easily usable application agent container can thereby be provided. A "pad-shaped" basic shape in this context is understood particularly as a shape that has two main directions of extension extending perpendicular to one another and a transverse direction of extension extending perpendicular to the main directions of extension, wherein dimensions along the main directions of extension are substantially the same, and a dimension along the transverse direction of extension is significantly smaller. The application agent container in this case preferably has a round cross-section in a cross-sectional plane in which the main directions of extension lie.

It is further proposed that the wall has at least one defined opening site, which is designed to be opened by an increase in pressure applied to the volume that is enclosed by the wall. In this manner, the application agent container can be opened particularly easily.

The defined opening site is preferably embodied as an area where the material of the wall is weakened. The defined opening site can thereby be easily defined. An "area where the material of the wall is weakened" is particularly understood in this context to mean that the strength of the wall in the region of the defined opening site is decreased, for example, as a result of a reduced wall thickness in the region and/or a connection between parts of the wall which is embodied as weaker than other connections.

It is further proposed that the application agent container comprises a pull-on element, which is provided for applying a pulling force to the wall. A force for dispensing the application agent can thereby be transferred particularly easily to the pull-on element. More particularly, in this manner, the application agent can be easily squeezed out by means of a suitable device. A "pull-on element" in this context is understood as an element that is securely fastened to the wall or is embodied as integral with the wall, and is designed for introducing a pulling force, for example, a loop, a tab, a reinforcement and/or a cord. In principle, the pull-on element can be at least partially dimensionally stable.

Further, a system comprising a device for applying at least one application agent to hair and comprising at least one application agent container is proposed, wherein the device comprises a housing unit, which has at least one depot volume for accommodating at least one component of the at least one application agent, and one dispenser unit, which is provided for opening the application agent container that is inserted at least partially into the depot volume, and for dispensing the application agent from the application agent container, particularly a system comprising a device according to the invention for applying at least one application agent to hair and comprising an application agent container according to the invention.

Additionally, as a further aspect of the invention, a method for a system comprising a device for applying at least one application agent to hair and comprising an application agent container is proposed, in which the application agent container is inserted at least partially into a depot volume of the device, and at least one component of an application agent is discharged from the application agent container. The application agent container is preferably inserted almost entirely into a depot volume of the device.

DRAWINGS

Further advantages are clear from the following description of the drawings. The drawings illustrate various embodiment examples of the invention. The drawings, the description, and the claims contain numerous features in combination. A person skilled in the art will also expediently consider the features individually and combine them in different combinations.

Figure 2:
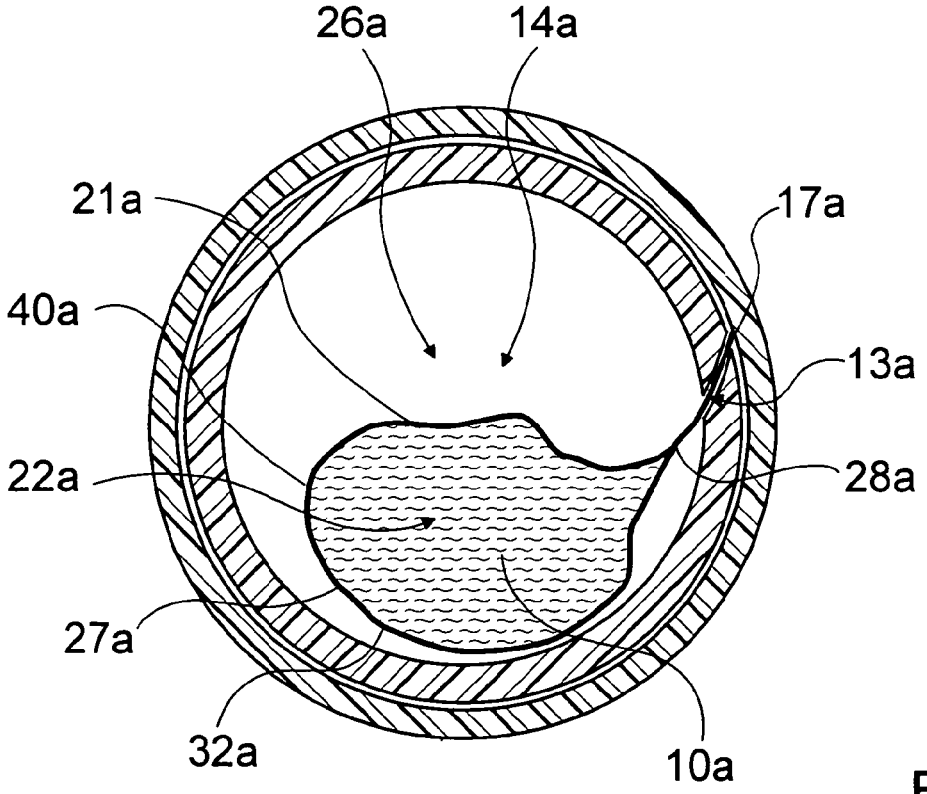
Figure 3:
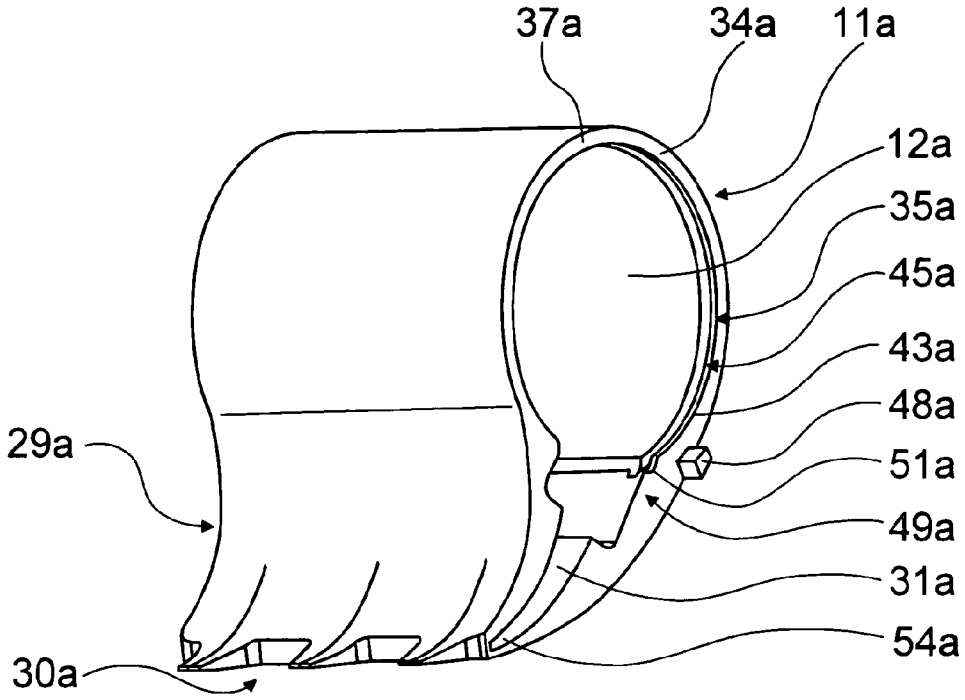
Figure 4:
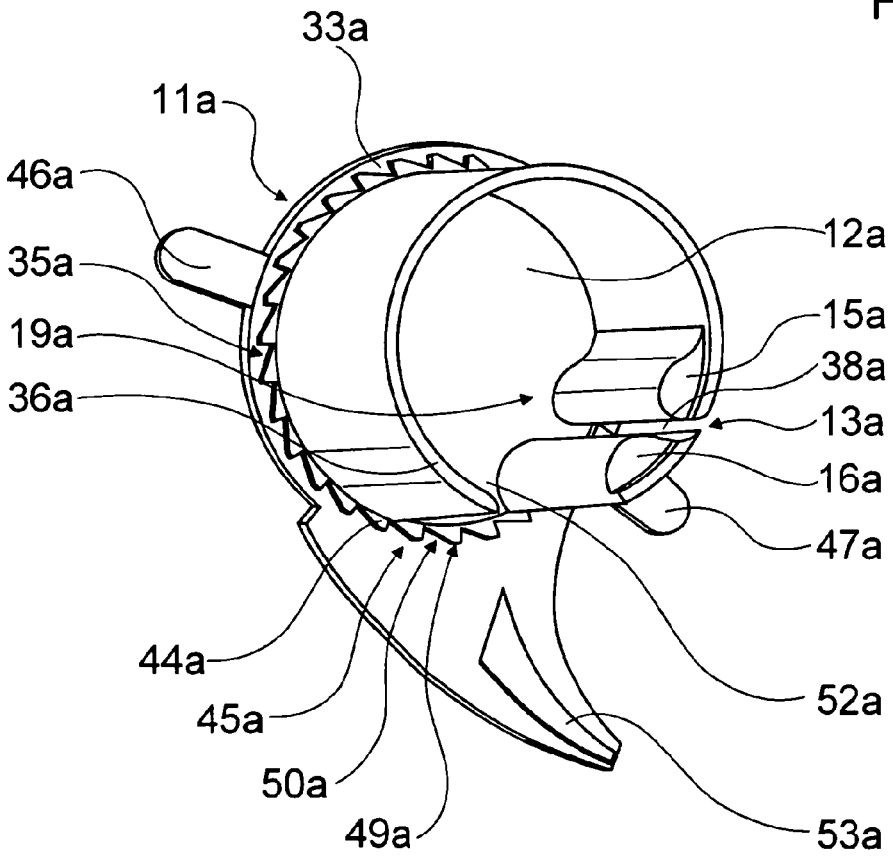
Figure 5:
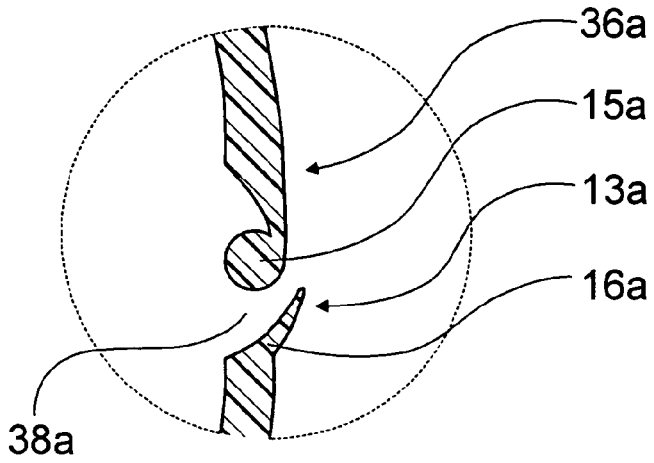
Figure 6:
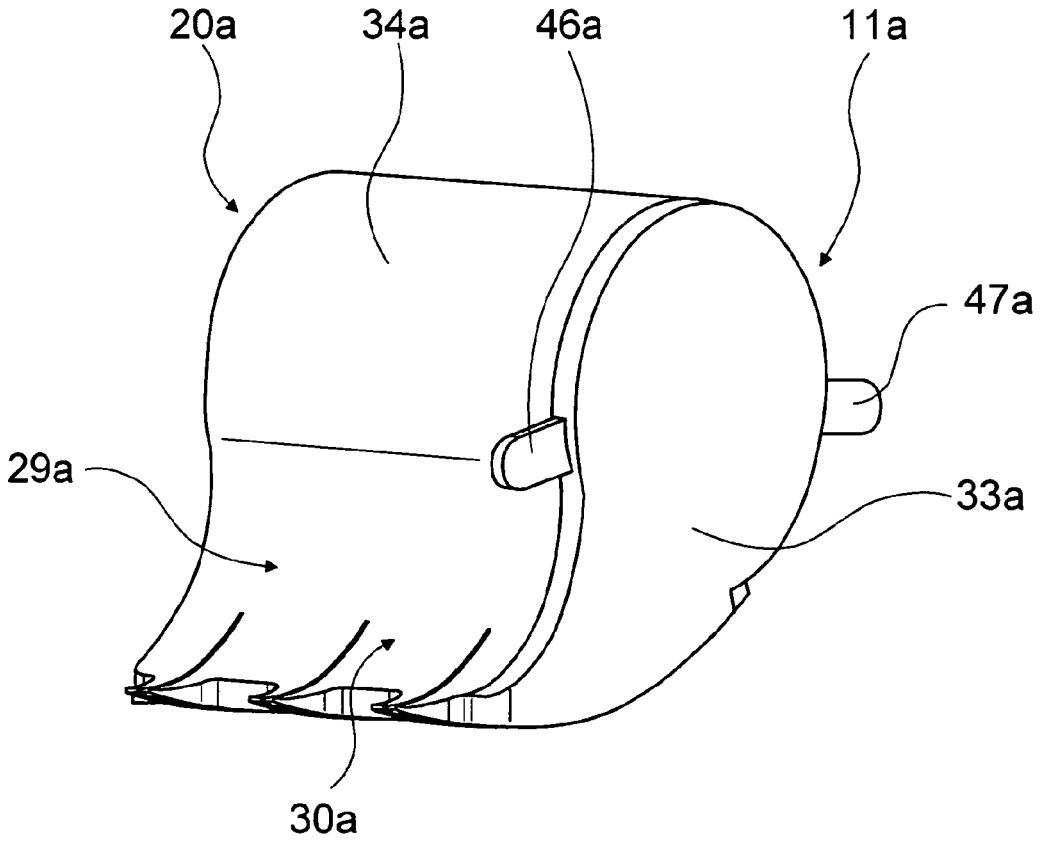
Figure 7:
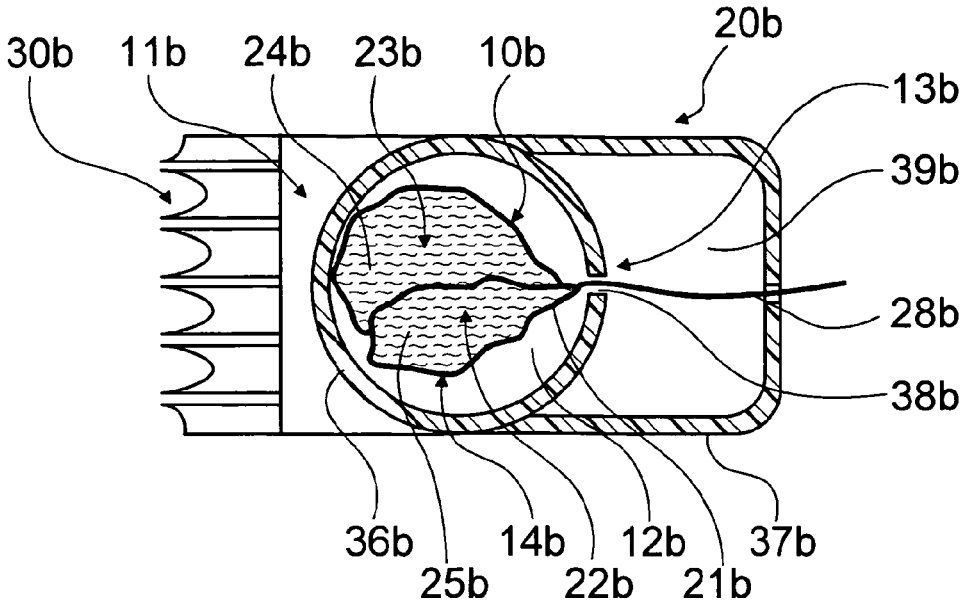
Figure 8:
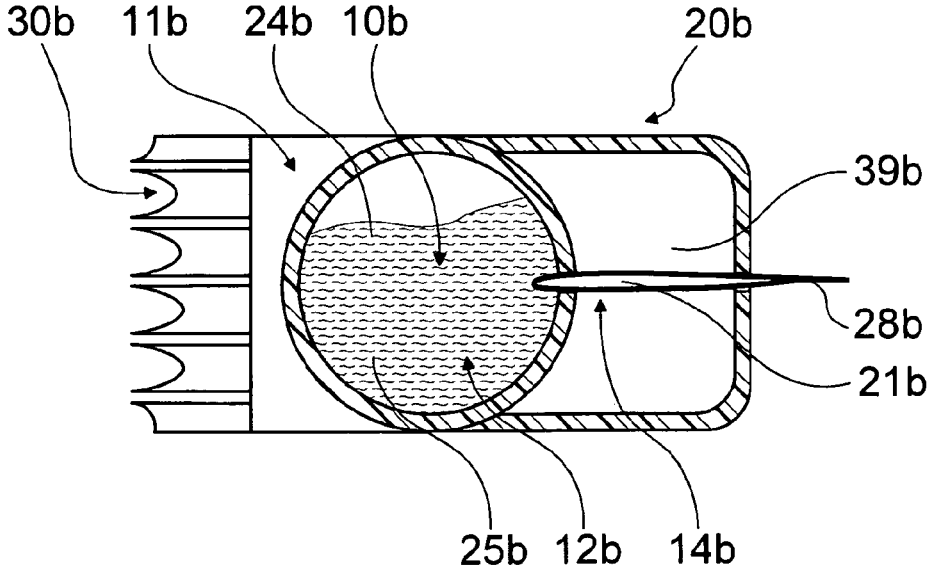
Figure 9:
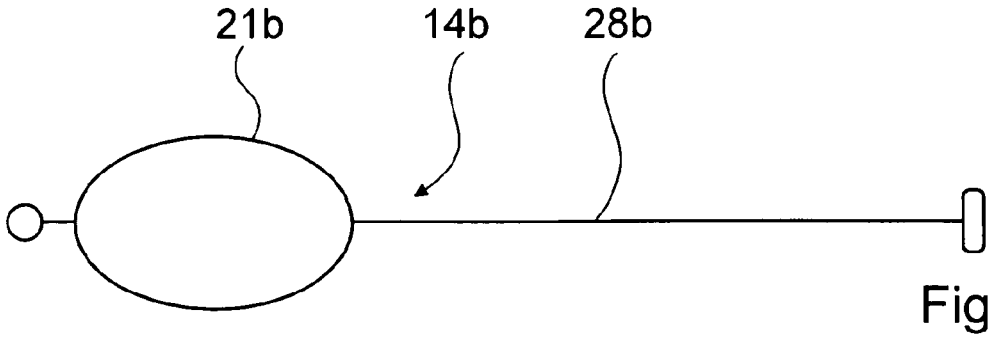
Figure 10:
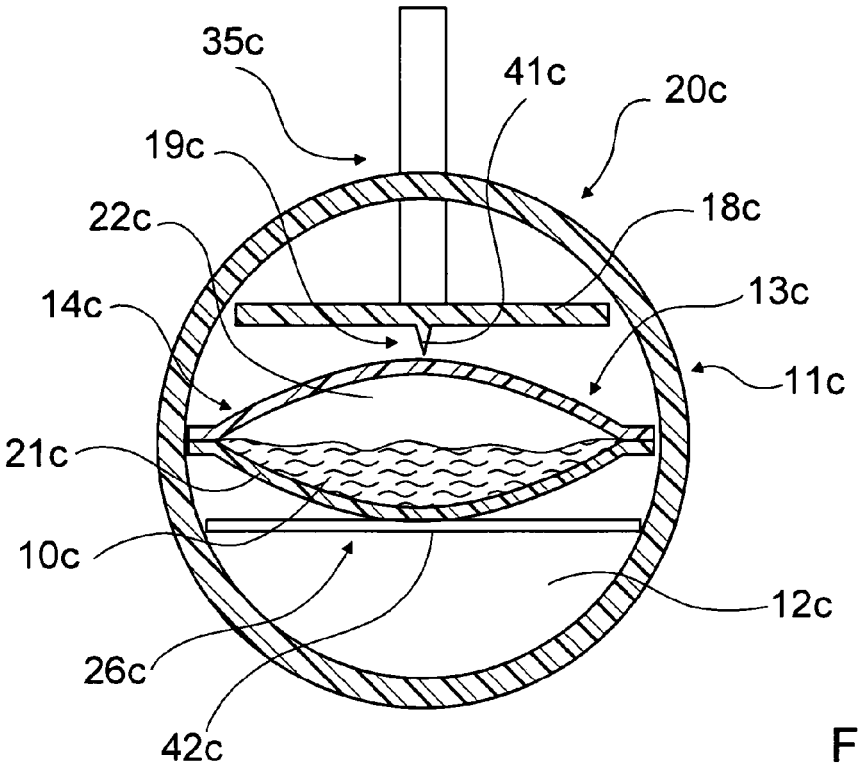
Figure 11:
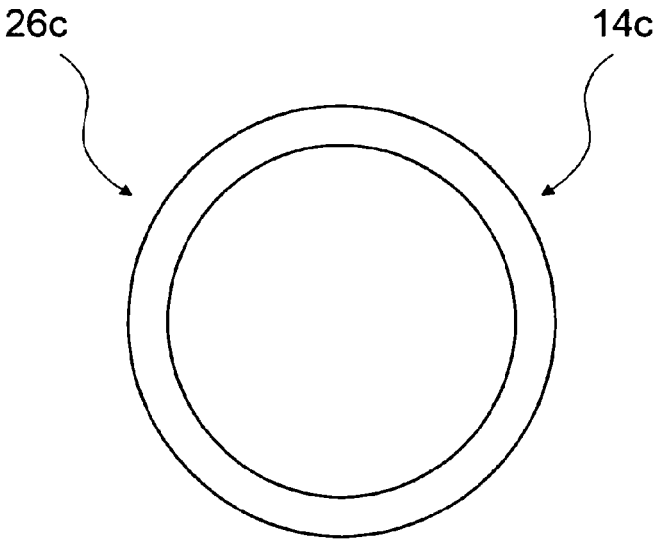

The drawings show:

FIG. 1 a cross-section of a device according to the invention,

FIG. 2 a schematic illustration of a system comprising the device of FIG. 1 and an application agent container according to the invention, FIG. 3 a perspective illustration of a base body of the device, FIG. 4 a perspective illustration of a side section of the device, FIG. 5 an enlarged illustration of a dispenser unit of the device, FIG. 6 an exterior view of the device, FIG. 7 an alternative embodiment of a system according to the invention, FIG. 8 the system of FIG. 7 in a state in which an application agent has been dispensed from the application agent container, FIG. 9 a schematic illustration of the application agent container, FIG. 10 a schematic illustration of a third embodiment of a system according to the invention having an application agent container, which has a pad-shaped basic shape, and FIG. 11 the application agent container of FIG. 10.

DESCRIPTION OF THE EMBODIMENT EXAMPLES

FIGS. 1 to 5 show schematic illustrations of a system comprising a device 20*a* according to the invention for applying an application agent 10*a* to hair and an application agent container 14*a* according to the invention. The device 20*a* is designed for private use and for professional use. Using the device 20*a*, a plurality of different application agents, such as hair dye, hair treatment agent, hair gloss, dispersion, body modifying agent and/or pharmaceutical hair treatment agent, can be applied to hair. The device 20*a* forms a hair treatment device. The device 20*a* is particularly provided for use on human head hair. In the present use, the application agent 10*a* is embodied as a hair dye or a hair coloring agent. In principle, the application agent 10*a* can be present in various states, for example, as a gas or as a powder, but is preferably liquid. In this embodiment example, the application agent 10*a* is embodied as a single-component agent. In principle, however, it is also conceivable for the application agent 10*a* to have multiple components.

In this case, the device is particularly embodied as a hair dye applicator device, which is designed for generating mottled coloring. Using the device, the application agent 10*a* is applied to the hair statistically distributed, i.e., hairs that are fully or partially provided with the application agent 10*a* are adjacent to hairs that are fully or partially provided with the application agent.

The device comprises a housing unit 11*a*, which encloses a depot volume 12*a*. The depot volume 12*a* is provided for accommodating the application agent 10*a*. To apply the application agent 10*a* to a part of the hair, the application agent 10*a* is first introduced into the depot volume 12*a*. The application agent 10*a* is then applied to the hair. Particularly with an application agent 10*a* having multiple components, it is conceivable for one component of the application agent 10*a* to already be placed in the depot volume 12*a* and to be mixed with the second component only directly before use of the device 20*a*.

For applying the application agent 10*a* to part of the hair, the device 10*a* comprises an applicator 29*a* with a separation unit 30*a*, through which the hair is passed. The separation unit 30*a* has a structure similar to that of a comb, by means of which application agent 10*a* is applied to those hairs which are isolated by the separation unit 30*a* as it passes through. The applicator 29*a* comprises an application volume 31*a* that is connected in terms of flow engineering to the depot volume 12*a*, wherein the hair penetrates partially into said application volume when it enters the separation unit 30*a*, whereby application agent 10*a* is applied to the hair provided for this purpose.

In principle, the applicator 29*a* for applying the application agent 10*a* to hair can be embodied as integral with the housing unit 11*a* which encloses the depot volume 12*a*, or as separate from the housing unit 11*a*. For example, it is conceivable for the applicator 29*a* and the housing unit 11*a* to be embodied as separate components, whereby the applicator 29*a* can be embodied as a multi-use component, whereas the housing unit 11*a* or at least the application agent container is embodied as a refillable product for exchanging or replacing the application agent 10*a*.

The application agent container 14*a* has a wall 21*a* which, when closed, encloses a volume 22*a* in which the application agent 10*a* is placed. The wall 21*a* is made of a dimensionally unstable material. The wall thickness of the material is within the range of a few tenths of a millimeter. Therefore, the wall 21*a* is not designed to accommodate a partial vacuum.

The material the wall 21*a* is made of is embodied as a film. The wall 21*a*, which is therefore in the form of a film, is adapted to the chemical properties of the application agent 10*a*. In the embodiment example shown, the wall 21*a* is embodied as a single-layer film. In principle, however, it is also conceivable for the wall 21*a* to be produced from a multi-layer film. In this embodiment example, the application agent container 14*a* has a tubular basic shape 26, which is designed for squeezing along its main direction of extension. The wall 21*a* defines the basic shape assumed by the application agent container 14*a* in the filled state.

The wall 21*a* comprises a defined opening site 27*a*. The defined opening site 27*a* is embodied as an area where the material is weakened. When the pressure in the volume 22*a* enclosed by the wall 21*a* in the closed state is increased, the wall 21*a* will open in the region of the defined opening site 27*a*, allowing application agent 10*a* to be discharged from the application agent container 14*a*.

The wall 21*a* is produced by stacking and partially welding or gluing a blank. A lateral edge 32*a* or a portion of the lateral edge 32*a* along which the blank will be welded or glued is designed as the defined opening site 27*a*. In the partial area provided as the defined opening site 27*a*, the lateral edge 32*a* is designed as weakened as compared with the remaining areas of the lateral edge 32*a*. The defined opening site 27*a* can be opened by increasing the pressure in the volume 22*a* that is enclosed by the wall 21*a*.

The application agent container 14*a* can be inserted almost entirely into the depot volume 12*a*. The application agent 10*a* that is introduced into the application agent container 14*a* is then particularly held entirely within the depot volume 12*a*. In order for the application agent container 14*a* to be inserted into the depot volume 12*a*, the housing unit 11*a* is embodied as comprising multiple parts. The housing unit 11*a* comprises a base body 34*a* and a side section 33*a*, which has been removed from the base body 34*a* to allow insertion of the application agent container 14*a*. The application agent container 14*a* is inserted into the base body 34*a*. The base body 34*a* then spans the depot volume 12*a*. The side section 33*a* is then attached to the base body 34*a*, thereby mounting the housing unit 11*a* and sealing the depot volume. The side section 33*a* is then secured to the base body 34*a*. The housing unit 11*a* can therefore be detached again only by destroying it. A connection between the side section 33*a* and the base section 34*a* can be implemented both positively and adhesively. For professional use, however, it is also conceivable particularly for the housing unit 11*a* to be designed for disassembly without destruction, for example, for replacing the application agent container 14*a*.

For securing the housing unit 11*a*, the base body 34*a* comprises an undercut 43*a*. The side section 33*a* comprises an engagement element 44*a*, which engages in the undercut 43*a* when the housing unit 11*a* is joined. The undercut 43*a* and the engagement element 44*a* thus form a latching unit 45*a*, which is secured by compression. The latching unit 45*a* cannot be detached again without destroying the undercut 43*a* or the engagement element 44*a*. The latching unit 45*a* enables a rotational movement of the side section 33*a* relative to the base body 34*a*.

Irrespective of whether the housing unit 11*a* is embodied as detachable or as non-detachable, a seal, which is not illustrated in greater detail, is applied to the housing unit 11*a*, and characterizes the status of the device 20*a*. The seal indicates whether the device 20*a* has already been used and whether the application agent 10*a* is an original product.

The seal comprises two seal elements 46*a*, 47*a*. The seal elements 46*a*, 47*a* can be removed by a user. The base body 34*a* and the side section 33*a* can be arranged in three different positions relative to one another. The first position is a storage or supply position. In the first position, the application agent container 14*a* is filled, i.e., the application agent 10*a* has not yet been dispensed from the application agent container 14*a*. The second position is embodied as a mixing position, in which the application agent 10*a* dispensed from the application agent container 14*a* is mixed, or a component that has been dispensed from the application agent container 14*a* can be mixed with a component that is already in the depot volume 12*a*. The third position is embodied as an application position, in which the application agent 10*a* can be applied to the hair.

The seal elements 46*a*, 47*a* separate the positions from one another. The first seal element 46*a* must be removed to bring the device 20*a* from the storage or delivery position to the mixing position. The second seal element 47*a* must be removed to bring the device 20*a* from the mixing position to the application position. The seal elements 46*a*, 47*a* are embodied as tabs which can be broken off for removal. The seal elements 46*a*, 47*a* are attached to the side section 33*a*. The base body 34*a* has a stop element 48*a*, on which the seal elements 46*a*, 47*a* rest in the storage or delivery position and in the mixing position.

The device 20*a* comprises a dispenser unit 13*a*, which is provided for discharging the application agent 10*a* from the application agent container 14*a*. The dispenser unit 13*a* comprises two squeezing elements 15*a*, 16*a*, between which the wall 21*a* of the application agent container 14*a* can be inserted. The application agent container 14*a* can be inserted in the filled state into the dispenser unit 13*a*. In the inserted state, the wall 21*a* of the application agent container 14*a* rests against the squeezing elements 15*a*, 16*a* of the device 20*a*. A distance between the two squeezing elements 15*a*, 16*a* is adapted to the thickness of the wall 21*a*. The distance between the squeezing elements 15*a*, 16*a* is a maximum of a few millimeters. The two squeezing elements 15*a*, 16*a* form a slit-type opening 38*a*, which has a substantially constant width along its greatest extension.

The application agent container 14*a* is embodied as a pouch. It comprises a pull-on element 28*a*, by means of which a pulling force can be transferred to the application agent container 14*a*. The pulling force that can be transferred by means of the pull-on element 28*a* is provided for moving the application agent container 14*a* through the dispenser unit 13*a*. The pull-on element 28*a* in this case is attached at one end of the wall 21*a*, which is opposite the defined opening site 27*a*. In a state in which the filled application agent container 14*a* is inserted into the dispenser unit 13*a*, the dispenser unit 13*a* is arranged between the pull-on element 28*a* and the defined opening site 27*a* in relation to the main direction of extension of the application agent container 14*a*.

The pull-on element 28*a* is embodied as a cord or a tape. The dispenser unit 13*a* is designed for manual actuation. For actuation, the device 20*a* comprises an actuator mechanism 35*a*. The actuator mechanism 35*a* is provided for converting the force applied by a user or operator to the pulling force that is transferred via the pull-on element 28*a* to the application agent container 14*a*. The actuator mechanism 35*a* of the device 20*a* comprises a pull-on element 17*a*, which can be connected to the pull-on element 28*a* of the application agent container 14*a*.

The actuator mechanism 35*a* is embodied as partially integral with the housing unit 11*a*. The housing unit 11*a* comprises an inner housing element 36*a* and an outer housing element 37*a*. The two housing elements 36*a*, 37*a* are rotatable relative to one another. The pull-on element 17*a* of the actuator mechanism 35*a* is attached to the outer housing element 37*a*. The dispenser unit 13*a* is securely connected to the inner housing element 36*a*. The squeezing elements 15*a*, 16*a* are embodied as integral with the inner housing element 36*a*.

The inner housing element 36*a* encloses the depot volume 12*a* of the device. In the inserted state, the wall 21*a* of the application agent container 14*a* is arranged inside the inner housing element 36*a*. The pull-on element 28*a* of the application agent container 14*a*, which can be embodied as integral with the wall 21*a*, is inserted through the dispenser unit 13*a*. The dispenser unit 13*a* in this case forms the opening 38*a* in the inner housing element 36*a*.

The pull-on element 28*a* of the application agent container 14*a* is attached to the pull-on element 17*a* of the device 20*a*. For discharging the application agent 10*a* from the application agent container 14*a*, the outer housing element 37*a* is rotated against the inner housing element 36*a*. The rotational movement increases a distance in the circumferential direction between the dispenser unit 13*a* and the pull-on element 17*a* of the device 20*a*. In this manner, the wall 21*a* of the application agent container 14*a* is drawn through the dispenser unit 13*a* of the device 20*a*.

As a result of the pulling force exerted on the application agent container 14*a* that has been inserted into the device 20*a*, an internal pressure in the volume 22*a* enclosed by the wall 21*a* increases. The increase in pressure opens the wall 21*a* at the defined opening site 27*a*, thereby allowing the application agent 10*a* to be discharged from the application agent container 14*a*. Further rotational movement of the outer housing element 37*a* relative to the inner housing element 36*a* causes the dispenser unit 13*a* to discharge the application agent 10*a* from the application agent container 14*a*. The squeezing elements 15*a*, 16*a* then force the application agent 10*a* out of the application agent container 14*a*.

In this case, the squeezing elements 15*a*, 16*a* of the dispenser unit 13*a* are adapted to a pulling direction along which the application agent container 14*a* is guided through the dispenser unit 13*a*. The first squeezing element 15*a*, which is arranged on the inside relative to the pulling direction, has a convexly rounded shape. The second squeezing element 16*a*, which is arranged on the outside, has a concavely rounded shape. The outer squeezing element 16*a* has a flatter curvature than the inner squeezing element 15*a*. The average width of the opening 38*a* formed by the squeezing elements 15*a*, 16*a* therefore decreases continuously along the pulling direction.

The dispenser unit 13*a* is therefore embodied as integral with an opening unit 19*a*. The opening unit 19*a* is designed for opening the application agent container 14*a* inside the depot volume 12*a*. By means of the opening unit 19*a*, the application agent container 14*a* can be opened in a state in which the housing unit 11*a* is sealed. The opening unit 19*a* is particularly formed by the differently curved squeezing elements 15*a*, 16*a*, which enable a pressure increase that is advantageous for opening the application agent container 14*a*.

In principle, it is conceivable for the opening unit 19*a* to additionally have at least one element, for example, an edge, which is provided for opening the application agent container 14*a* at a specific site. If the opening unit 19*a* has an opening element, it is not necessary to provide the application agent container 14*a* with a defined opening site. It is particularly also conceivable for the opening unit 10*a* to have two opening elements that are movable relative to one another, and for the opening unit to be designed to actively tear open or cut into the application agent container 14*a*. In this case, a movement of the housing elements 36*a*, 37*a* is preferably provided for actively opening the application agent container 14*a*.

The inner housing element 36*a* and the outer housing element 37*a* are embodied as spaced at least in sections. During emptying, the application agent container 14*a* is drawn through the dispenser unit 13*a* into an intermediate space 39*a* between the two housing elements 36*a*, 37*a*.

To seal the opening 38*a* formed by the dispenser unit 13*a*, the application agent container 14*a* has an end piece 40*a*. The end piece 40*a* is embodied as a thickened area, which is larger than the width of the opening 38*a*. As soon as the application agent container 14*a* is drawn into the intermediate space 39*a*, the end piece 40*a* seals the opening 38*a*. The application agent 10*a* is therefore discharged nearly completely from the application agent container 14*a* and introduced into the depot volume 12*a*.

The outer housing element 37*a* is embodied as integral with the base body 34*a*. The base body 34*a* forms a side wall, the depot volume 12*a* and the application volume 31*a*. The inner housing element 36*a* is embodied as integral with the side section 33*a*. The side section 33*a* forms a second side wall.

The inner housing element 36*a* has an annular base structure. The opening 38*a* in the dispenser unit 13*a* is brought out as a first opening in the annular base structure. The inner housing element 36*a* further has an opening 52*a*, which is provided for connecting the depot volume 12*a* to the application volume 31*a*. The depot volume 12*a* is enclosed in at least one state by the inner housing element 36*a*, whereas the application volume 31*a* is arranged outside of the inner housing element 36*a*.

The actuator mechanism 35*a* has a reverse rotation stop 49*a*, which is designed to prevent the outer housing element 37*a* from rotating relative to the inner housing element 36*a* in a direction in which the distance between the pull-on element 17*a* of the device 20*a* and the dispenser unit 13*a* is decreased. To form the reverse rotation stop 49*a*, the actuator mechanism 35*a* comprises a ratcheting mechanism. If the device 20*a* is particularly provided for professional use, the actuator mechanism 35*a* can be designed to be rotated back to a starting position for replacing the application agent container 14*a*, or the reverse rotation stop 49*a* can be dispensed with entirely.

The reverse rotation stop 49*a* is embodied as partially integral with the latching unit 45*a* for joining the housing unit 11*a*. The engagement element 44*a* of the side section 33*a* has teeth 50*a*. The base body 34*a* comprises an engagement element 51*a* which, in the mounted state, engages with the teeth 50*a* of the side section 33*a*. In this, the teeth 33*a* form ratcheting teeth, with which the side section 33*a* can be rotated relative to the base body 34*a* in one direction, but reverse rotation in an opposite direction is prevented.

In the first position, the first seal element 46*a* rests against the stop element 48*a* of the base body 34*a*. In the first position, the inner housing element 36*a* seals a passageway from the depot volume 12*a* to the application volume 31*a*. The depot volume 12*a* is therefore uncoupled from the application volume 31*a*.

Once the first seal element 46*a* has been removed, the side section 33*a* can be rotated relative to the base body 34*a* to the second position. A path along which the side section 33*a* is rotated relative to the base body 34*a* is the same as the path that is necessary for dispensing the application agent 10*a* from the application agent container 14*a*. During rotation, a majority of the application agent 10*a* is dispensed from the application agent container 14*a*.

In the second position, the inner housing element 36*a* continues to seal off the passageway from the depot volume 12*a* to the application volume 31*a*. The second position is embodied as the mixing position. In the second position the application agent 10*a*, or the individual components of the application agent 10*a*, can be mixed with one another.

A ball, not described in greater detail, can be placed in the depot volume 12*a* as a mixing unit. The ball is freely movable in the depot volume. In principle, however, other embodiments are also conceivable.

Once the second seal element 47*a* has been removed, the side section 33*a* can be rotated relative to the base body 34*a* to the third position. During displacement from the second position to the third position, the opening 52*a* opens up the passageway from the depot volume 12*a* to the application volume 31*a*. To secure the housing unit 11*a* in the third position, the side section 33*a* comprises a nose 53*a*, which is designed to engage in a corresponding recess 54*a* on the base body 34*a*. The nose 53*a* is connected to a projection on the side section 33*a*, which is provided for sealing the application volume 31*a*. The recess 54*a* is formed in a separator element of the separation unit 30*a*.

The application volume 31*a* is also bordered on one side by the side section 33*a*. As the passageway from the depot volume 12*a* to the application volume 31*a* is opened, the side section 33*a* successively closes off the application volume 31*a*. In the application position, the depot volume 12*a* and the application volume 31*a* are connected to one another and sealed toward the outside.

Based upon the seal elements 46*a*, 47*a* and the actuator mechanism 35*a*, a user can determine the position of the device 20*a*. The housing unit 11*a* is substantially transparent. The housing unit 11*a* is made of plastic. The composition of the material of the housing unit 11*a* is adapted to the application agent 10*a*. The housing unit 11*a* is particularly adapted to features such as oxygen permeability, chemical resistance and/or transparency. The housing unit 11*a* and/or the application agent container 14*a* are preferably oxygen permeable.

The same device can be used with an application agent container which is not illustrated in greater detail in this embodiment example, and which is provided for an application agent having a plurality of components. An application agent container of this type has a wall, which encloses multiple volumes, each of which holds one of the components. Each of the volumes has a defined opening site. When the application agent container is squeezed, all the defined opening sites are opened, thereby introducing the individual components into the depot volume of the device. To mix the individual components in the depot volume, the device of such an embodiment can have a pump unit, which is provided for generating a turbulent flow in the application agent introduced into the depot volume. The pump unit in such an embodiment preferably comprises a pump element that is arranged freely movable in the depot volume, and is particularly preferably embodied as a ball placed in the depot volume. The pump element therefore advantageously forms a mixing element of the mixing unit, and is provided for mixing the application agent 10*a*. The pump element is preferably introduced into the depot volume during manufacture. In principle, however, it is also conceivable for the pump element to be first arranged in the application agent container and to be dispensed together with the application agent from the application agent container.

FIGS. 7 to 11 show two additional embodiment examples of the invention. The following descriptions will be limited essentially to the differences between the embodiment examples, wherein with respect to components, features and functions that remain unchanged, reference can be made to the description of the other embodiment examples, particularly of FIGS. 1 to 6. To distinguish between the embodiment examples, the letter a used in the reference signs of the embodiment example illustrated in FIGS. 1 to 6 is replaced by the letters b and c in the reference signs of the embodiment examples of FIGS. 7 to 11. With respect to components having the same designation, particularly with respect to components having the same reference signs, reference can also be made in principle to the drawings and/or the description of the other embodiment examples, particularly of FIGS. 1 to 6.

FIGS. 7 to 9 show schematic illustrations of a system having a device 20*b* according the invention for applying an application agent 10*b* to hair, and having an application agent container 14*b* according to the invention. The device 20*b* comprises a housing unit 11*b*, which encloses a depot volume 12*b* for accommodating the one application agent 10*b*. The device 20*b* further comprises a dispenser unit 13*b* which is provided for discharging the application agent 10*b* from an application agent container 14*b* that is at least partially inserted into the depot volume 12*b*. The dispenser unit 13*b* is provided for manual actuation and therefore for manually dispensing the application agent 10*b* from the application agent container 14*b*.

In contrast to the preceding embodiment example, an actuator mechanism is dispensed with. Similarly to the preceding embodiment example, the application agent container 14*b* comprises a pull-on element 28*b*, which is connected to a wall 21*b* of the application agent container 14*b*.

The wall 21*b* encloses two volumes 22*b*, 23*b*, in which different components 24*b*, 25*b* of the application agent 10*b* are placed. The pull-on element 28*b* is embodied as a cord.

The housing unit 11*b* of the device 20*b* comprises two parts. It comprises a first housing element 36*b*, which encloses the depot volume 12*b*, and a second housing element 37*b*, which is arranged in a partial region spaced from the first housing element 36*b*. In a state in which the completely filled application agent container 14*b* is inserted into the device 20*b*, the pull-on element 28*b* of the application agent container 14*b* extends through an intermediate space 39*b* between the two housing elements 36*b*, 37*b*.

The pull-on element 28*b* is further guided through the outer housing element 37*b* to the outside. To discharge the application agent 10*b* from the application agent container 14*b*, a user pulls on the pulling means 28*b* that extends to the outside, thereby drawing the application agent at least partially through the dispenser unit 13*b*, which forms an opening 38*b* in the inner housing element 36*b*. To establish a pulling direction along which the pull-on element of the application agent container 14*b* can be moved, the housing unit 11*b* comprises an actuator mechanism that is not illustrated in greater detail.

Alternatively, it is also conceivable for the second housing element 37*b* to be at least partially linearly displaceable relative to the first housing element 36*b*. In such an embodiment, the two housing elements 36*b*, 37*b* form an actuator mechanism, wherein the outer housing element 37*b* is embodied as a pull-on element of the device 20*b*, to which the pull-on element 28*b* of the application agent container 14*b* is securely attached or can be securely attached.

FIGS. 10 and 11 illustrate an alternative embodiment of the application agent container 14*c* and parts of a device 20*c*. The application agent container 14*c* is designed for insertion completely into a depot volume 12*c* of the device 20*c*. The application agent container 14*c* is embodied as a pad. It has a pad-shaped basic shape 26*c*. The application agent container 14*c* comprises a wall 21*c*, which is made of a film-like material and which encloses a volume 22*c*.

The schematically illustrated device 20*c* for which the application agent container 14*c* is provided comprises a depot volume 12*c*, which is designed to fully accommodate the application agent container 14*c*. The device 20*c* further comprises a dispenser unit 13*c*, which is provided for discharging an application agent 10*c* from the application agent container

14*c*. For this purpose, the device 20*c* comprises an actuator mechanism 35*c*, which is designed for exerting compressive force on the application agent container 14*c*.

The dispenser unit 13*c* is embodied as partially integral with an opening unit 19*c*. The opening unit 19*c* comprises an opening element 41*c*, which has an at least partially sharp-edged form. For squeezing out the application agent 10*c*, the opening unit 19*c* first pokes through or cuts through the application agent container 14*c*. The dispenser unit 13*c* then forces the application agent 10*c* out of the application agent container 14*c*.

The dispenser unit 13*c* comprises a pressing element 18*c*, which is movably arranged. The actuator mechanism 35*c* is provided for moving the pressing element 18*c*. The dispenser unit 13*c* further comprises a fixed element 42*c*, relative to which the pressing element 18*c* is movable. The application agent container 14*c* used in the device 20*c* is positioned between the pressing element 18*c* and the fixed element 42*c*. The opening element 41*c* is coupled in terms of motion engineering with the actuator mechanism 35*c* for actuating the dispenser unit 13*c*. The opening element 41*c* is embodied as a sharp pin, which is arranged on the pressing element 18*c*. In the embodiment example shown, the fixed element 42*c* is embodied as a grid element. In principle, however, other embodiments are also conceivable, for example, an integral embodiment of the fixed element 42*c* with a housing unit 11*c*.

In principle, the opening element 41*c* can also have other forms, for example, it is conceivable for the opening element 41*c* to be embodied in the form of a cutting edge, which cuts through the wall 21*c* of the application agent container. It is also conceivable for the application agent container 14*c* to be designed with a defined opening site, which is embodied similarly to the preceding embodiment examples as an area in which the material is weakened, wherein in an embodiment of this type, the opening element 41*c* can be dispensed with.

LIST OF REFERENCE SIGNS

| | |
|---|---|
| 10 | Application agent |
| 11 | Housing unit |
| 12 | Depot volume |
| 13 | Dispenser unit |
| 14 | Application agent container |
| 15 | Inner squeezing element |
| 16 | Outer squeezing element |
| 17 | Pull-on element |
| 18 | Pressing element |
| 19 | Opening unit |
| 20 | Device |
| 21 | Wall |
| 22 | Volume |
| 23 | Volume |
| 24 | Component |
| 25 | Component |
| 26 | Basic shape |
| 27 | Defined opening site |
| 28 | Pull-on element |
| 29 | Applicator |
| 30 | Separation unit |
| 31 | Application volume |
| 32 | Lateral edge |
| 33 | Side section |
| 34 | Base body |
| 35 | Actuator mechanism |
| 36 | Inner housing element |
| 37 | Outer housing element |
| 38 | Opening |
| 39 | Intermediate space |
| 40 | End piece |
| 41 | Opening element |

-continued

| | |
|---|---|
| 42 | Fixed element |
| 43 | Undercut |
| 44 | Engagement element |
| 45 | Latching unit |
| 46 | Seal element |
| 47 | Seal element |
| 48 | Stop element |
| 49 | Reverse rotation stop |
| 50 | Teeth |
| 51 | Engagement element |
| 52 | Opening |
| 53 | Nose |
| 54 | Recess |

The invention claimed is:

1. A device for applying at least one application agent (10*a*; 10*b*; 10*bc*) to hair, comprising:

a housing unit (11*a*; 11*b*; 11*c*) which at least partially encloses at least one depot volume (12*a*; 12*b*; 12*c*) for accommodating at least one component of the at least one application agent (10*a*; 10*b*; 10*c*);

an application agent container (14*a*; 14*b*; 14*c*) at least partially inserted into the depot volume, the application agent container having a wall (21*a*) which, when closed, encloses a volume (22*a*) including the at least one application agent and wherein the wall has at least one defined opening site (27*a*; 27*b*; 27*c*) configured to open in response to an increase in pressure in the volume enclosed by the wall;

a dispenser unit (13*a*; 13*b*; 13*c*), which is provided for discharging the at least one component of the application agent (10*a*; 10*b*; 10*c*) from the application agent container (14*a*; 14*b*; 14*c*), the dispenser unit comprising two squeezing elements (15*a*; 16*a*) and the wall of the application agent container configured to be insertable between the two squeezing elements; and a pull-on element (28*a*), that is securely fastened to the wall or is embodied as integral with the wall of the application container, which is provided for applying a pulling force to the wall and is designed to guide the application agent container past the squeezing elements and for drawing at least a part of the application agent container through the two squeezing elements, the pull-on element being inserted through the two squeezing elements.

2. The device according to claim 1, characterized in that the dispenser unit (13*a*; 13*b*) is provided for manual actuation.

3. The device according to claim 1, characterized by a pressing element (18*c*), which is provided for compressing the application agent container (14*c*).

4. The device according to claim 1, characterized by an opening unit (19*a*; 19*c*), which is provided for opening the application agent container (14*a*; 14*c*) inside the depot volume (12*a*; 12*c*).

5. The device according to claim 4, characterized in that the dispenser unit (13*a*; 13*b*; 13*c*) and the opening unit (19*a*; 19*b*; 19*c*) are embodied as at least partially integral.

6. A method for applying at least one application agent (10*a*; 10*b*; 10*c*) to hair with a system comprising a device (20*a*; 20*b*; 20*c*) for applying the at least one application agent (10*a*; 10*b*; 10*c*) to hair, an application agent container (14*a*; 14*b*; 14*c*), which is inserted at least partially into a depot volume (12*a*; 12*b*; 12*c*) of the device (20*a*; 20*b*; 20*c*), enclosing at least one volume in which at least one component of an application agent is placed and which comprises a pull-on element (28*a*), that is securely fastened to a wall of the application agent container or is embodied as integral with the wall of the application container, and an opening unit which is provided for opening the application agent container and a dispenser unit (13*a*) comprising two squeezing elements (15*a*; 16*a*) the method comprising:

transferring a pulling force to the application agent container by means of the pull-on element, the pulling force moving and opening the application agent container through the two squeezing elements of the dispenser unit of the device;

squeezing the application agent container by the two squeezing elements and thereby forcing the at least one component of the application agent out of the application agent container; and discharging the at least one application agent (10*a*; 10*b*; 10*c*) from the application agent container (14*a*; 14*b*; 14*c*).

7. The device according to claim 1, further comprising an actuator mechanism with an actuator mechanism pull-on element connected to the pull on element (28*a*) of the application agent container, that is securely fastened to the wall or is embodied as integral with the wall of the application container, the actuator mechanism configured to convert a force applied by a user or operator to a pulling force that is transferred via the pull-on element (28*a*) of the application agent container.

8. The device according to claim 1, wherein the pull-on element (28*a*) is attached at one end of the wall (21*a*), which is opposite the defined opening site (27*a*) and wherein the dispenser unit (13*a*) is arranged between the pull-on element (28*a*) and the defined opening site (27*a*) in relation to the main direction of extension of the application agent container (14*a*).

9. The device according to claim 1 further comprising an actuator mechanism (35*a*) embodied as partially integral with the housing unit (11*a*) and comprises a pull-on element (17*a*), and at least two housing parts, an inner housing element (36*a*) and an outer housing element (37*a*), which are rotatable relative to one another, wherein the pull-on element (17*a*) of the actuator mechanism (35*a*) is attached to the outer housing element (37*a*) and connected to the pull-on element (28*a*) of the application agent container (14*a*).

10. The device according to claim 9 wherein the dispenser unit (13*a*) is secured to the inner housing element (36*a*).

11. The device according to claim 9 wherein the two squeezing elements (15*a*; 16*a*) are embodied as integral with the inner housing element (36*a*).

12. The device according to claim 9 wherein the dispenser unit (13*a*) forms an opening (38*a*) in the inner housing element (36*a*).

13. The device according to claim 9 wherein the two squeezing elements (15*a*; 16*a*) form a slit-type opening (38*a*) in the inner housing element (36*a*).

14. The method according to claim 6 wherein the device (20*a*; 20*b*; 20*c*) comprises at least two housing parts, an inner housing element (36*a*) and an outer housing element (37*a*), which are rotatable relative to one another, the method further comprising: rotating the outer housing element (37*a*) against the inner housing element (36*a*); and discharging the application agent (10*a*) from the application agent container (14*a*) in response to the rotating.

15. The method according to claim 14, wherein the rotating increases a distance in a circumferential direction between the dispenser unit (13*a*) and the pull-on element (17*a*), that is securely fastened to the wall or is embodied as integral with the wall of the application container and draws the wall (21*a*) of the application agent container (14*a*) through the dispenser unit (13*a*) of the device (20*a*).

* * * * *